United States Patent [19]

Veverka et al.

[11] Patent Number: 4,606,245

[45] Date of Patent: Aug. 19, 1986

[54] OPENING MECHANISM FOR BOTTLES HAVING CLOSURE ELEMENTS

[76] Inventors: Joseph F. Veverka, P.O. Box 324; Jerold L. Williams, P.O. Box 226, both of Prairie City, Iowa 50228

[21] Appl. No.: 717,016

[22] Filed: Mar. 28, 1985

[51] Int. Cl.[4] ..... B67B 7/02

[52] U.S. Cl. ..... 81/3.36; 81/3.4; 29/262

[58] Field of Search ..... 81/3.29, 3.36, 3.37, 81/3.4, 3.42, 3.44; 29/261, 262; 215/303

[56] References Cited

U.S. PATENT DOCUMENTS

| | | | |
|---|---|---|---|
| 559,803 | 5/1896 | Johnson | 29/262 |
| 580,639 | 4/1897 | Davis | 29/262 |
| 2,467,982 | 4/1949 | Maris | 29/263 |
| 2,484,043 | 10/1949 | Malen . | |
| 2,718,801 | 9/1955 | Finley . | |
| 2,732,741 | 1/1956 | Muller et al. . | |
| 2,761,338 | 9/1956 | Hector et al. . | |
| 4,422,355 | 12/1983 | Burns . | |
| 4,442,735 | 4/1984 | Chance et al. . | |
| 4,522,089 | 6/1985 | Alvi | 81/3.42 |

*Primary Examiner*—Roscoe V. Parker

*Attorney, Agent, or Firm*—Zarley, McKee, Thomte, Voorhees & Sease

[57] ABSTRACT

An opening mechanism for bottles having closure elements including a brace positionable against the bottle with leverage structure operatively associated with the brace and being movable oppositely against the brace. A grasping clevis is movable in response to the leverage structure. A control having an actuation portion is connected to the brace and positioned so that the grasping clevis abuts the actuation portion of the control at least when the grasping clevis is grasping the closure member of the bottle, the actuation portion being associated with the position of the closure element which causes the grasping clevis to close when the grasping clevis is moved to a grasping position.

10 Claims, 6 Drawing Figures

OPENING MECHANISM FOR BOTTLES HAVING CLOSURE ELEMENTS

BACKGROUND OF THE INVENTION

1. Field of Invention

This invention relates to opening mechanisms, and particularly, to opening mechanisms for bottles having closure elements.

2. Problems in the Art

Removal of closure elements from beverage holding bottles requires certainty in grasping force while at the same time accurate removal directional force so that the closure element can be successfully removed. For closure elements susceptible to it, a corkscrew is a traditional device for removing closure elements. Corkscrew devices present the problems of inserting the screw portion into the closure element sufficiently and without detrimental damage to the closure element, and then removal of the closure element without breakage or parts of the closure element falling into the beverage in the bottle. Moreover, many times problems exist with the user accurately providing manual pulling force in the correct outward axial direction. Many modern bottles also utilize closure element materials which are not susceptible of allowing insertion of corkscrews for removal.

Present opening mechanisms for bottles having closure elements which do not utilize the corkscrew method also have difficulties. While most of these devices utilize gripping jaws or set screws, many do not include means for positioning and supporting the device upon the bottle for greater accuracy in removing the closure element. Furthermore, many are complicated in structure, and require multiple adjustments to position the device and then grasp and release the closure elements. Such devices are cumbersome to operate and relatively expensive.

Many present devices also require manual pulling force which excludes the benefits of mechanical advantage.

It is also desirous and would be advantageous to have an opening mechanism for bottles having closure elements which automatically positions the opening mechanism and upon a single operational step automatically grasps the closure element and removes it.

It is therefore a primary object of the invention to improve over and solve the problems and deficiencies in the art.

A further object of the invention is to provide an opening mechanism for bottles having closure elements which automatically controls the grasping of the closure element and its removal.

Another object of the invention is to provide an opening mechanism for bottles having closure elements which automatically positions and braces the mechanism in preparation for removing the closure element.

Another object of the invention is to provide an opening mechanism for bottles having closure elements which provides automatic alignment of the mechanism so that its pulling force is automatically aligned along the longitudinal axis of the bottle preventing any disadvantageous pulling angles.

A further object of the invention is to provide an opening mechanism for bottles having closure elements which is simple to use and which can utilize mechanical advantage to remove the closure element.

A further object of the invention is to provide an opening mechanism for bottles having closure elements which is economical, simple in construction, and durable.

SUMMARY OF THE INVENTION

This invention utilizes structure which allows the bracing, positioning, grasping, and removal of a closure element of a bottle in a single step. After positioning of the mechanism upon the bottle, the single step comprises simply operating a leverage means which can utilize mechanical advantage by being movable oppositely against a brace means abutting the bottle, to move a grasping means upwardly. A control means automatically actuates the grasping means at the proper time and location and the continued upward movement of the grasping means removes the closure element.

The structure to accomplish this advance in the art comprises the brace means which functions first to abut the bottle and position the mechanism, and second, provides a support by which opposite pulling force can be derived.

A leverage means is operatively associated with the brace means to provide the pulling force and and upward movement of the grasping means.

The grasping means is directly connected to the leverage means and is automatically closed to grasp the closure element at the grasping position which is automatically set upon positioning of the opening mechanism on the bottle. An actuation portion of the control means causes the grasping means to grasp the closure element at the appropriate time and position, and continues to grasp it until it is removed from the bottle.

By reversed movement of the leverage means so that the grasping means is no longer in contact with the actuation portion of the control means allows the grasping means to open and release the closure element.

DETAILED DESCRIPTION OF THE PREFERRED EMBODIMENT

Figures 1, 2, 3, 4, 5, 6:
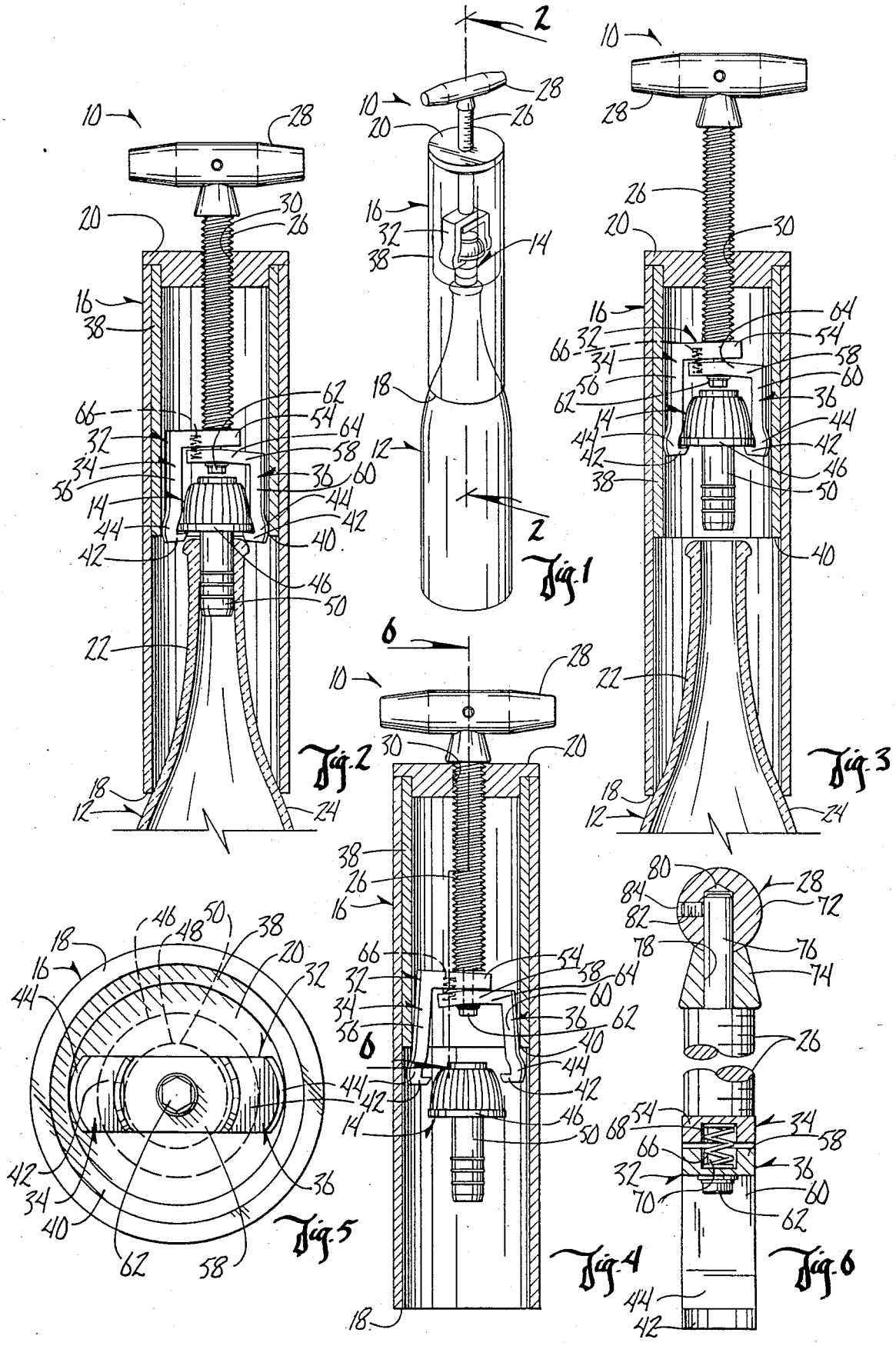
FIG. 1 is a perspective view of the invention positioned upon a bottle having a closure element.
FIG. 2 is a sectional view of the invention taken along lines 2—2 of FIG. 1, and showing the grasping of the closure element when the closure element is in place on the bottle.
FIG. 3 is a sectonal view similar to FIG. 2 except showing the mechanism after the closure element has been removed.
FIG. 4 is a sectional view similar to FIGS. 2 and 3, except showing the mechanism removed from the bottle and showing how the closure element is released.
FIG. 5 is a bottom view of the invention.
FIG. 6 is a sectional view taken along lines 6—6 of FIG. 4.

Referring to the drawings, and particularly FIG. 1, there is shown an opening mechanism 10 for bottles having closure elements. Opening mechanism 10 is positioned upon bottle 12 having closure element 14. Opening mechanism 10, in the preferred embodiment shown in the drawings, has a brace means comprised of a tubular housing 16 having an open lower end 18 and a closed top end 20. Lower end 18 of housing 16 is positionable over closure element 14 and neck 22 of bottle 12, and abuts shoulder 24 of bottle 12.

A leverage means comprised of a threaded rod 26 and handle 28 extends through a threaded opening 30 in closed top end 20 of housing 16. The lower end of threaded rod 26 is connected to a grasping means which is comprised of lifting clevis 32. Threaded rod 26 is freely rotatable in its connection to lifting clevis 32.

The control means by which the grasping and opening of lifting clevis 32 is directed in the preferred embodiment comprises simply the abutment of arms 34 and 36 of lifting clevis 32 against the inside surface of housing 16 which has an actuation portion comprised of a second or inner tube 38 positioned within tubular housing 16. The width of the inner diameter of housing 16 thus controls whether lifting clevis 32 is open or closed.

By referring to FIGS. 2–4, the operation of opening mechanism 10 can be readily seen. In FIGS. 2 and 3, opening mechanism 10 is shown in position in abuttment with shoulders 24 of bottle 12. The housing 16 of opening mechanism 10 is configured so that lower end 40 of inner tube 38 is automatically aligned with the exact position on bottle 12 where it is desired to have arms 34 and 36 of lifting clevis 32 close and grasp closure element 14. It will thus be understood that housing 16 can be manufactured for various lengths and inne tube 38 can be positioned at various positions within housing 16 for various sized and configured bottles 12 so that the automatic closing feature of the invention is maintained for different bottles 12. Furthermore, it is to be understood that the invention is not limited as to the specific grasping means utilized, or the manner in which the closure element is grasped. For example, the preferred embodiment includes hook elements 42 at the lower ends of arms 34 and 36 which have bowed portions 44 so that element 14 is cradled underneath its rim 46 and then pulled upwardly. Alternatively, arms 34 and 36 could have toothed or other gripping means to directly claw or pinch the closure element 14 for grasping.

FIG. 2 shows how the smaller inside diameter of inner tube 48 forces the arms 34, 36 of lifting clevis 32 inwardly at that point to grasp closure element 14. By continuing to rotate handle 28 in the appropriate direction, the action of threaded rod 26 acting oppositely against housing 16 causes lifting clevis 32 to be raised within housing 16 while continuing to grasp closure element 14 as can be seen in FIG. 3. Lifting clevis 32 continues to grasp closure element 14 because inner tube 38 extends upwardly essentially to the top end of housing 16. Alternatively, inner tube 38 could terminate before the top of housing 16 and therefore arms 34, 36 would spread apart and release closure element 14 upon continued upward movement of lifting clevis 32.

Once closure element 14 is removed from bottle 12, opening mechanism 10 can be removed from the top of bottle 12, and handle 28 can be rotated in an opposite direction to move threaded rod 26 downwardly in threaded opening 30 of top end 20 of housing 16. Lifting clevis 32 is therefore moved downwardly and when it reaches a point where it moves past the lower end 40 of inner tube 38, the lower ends of arms 34, 36 of lifting clevis 32 are allowed to move apart from each other on the wider inside diameter of tubular housing 16 below inner tube 38. Closure element 14 is therefore released from the grasp of lifting clevis 32. (See FIG. 4). It should be understood that FIG. 4 also shows the position of lifting clevis 32 as it would be when opening mechanism 10 is initially inserted over a bottle in preparation for removing the closure element.

FIG. 5 shows the hook elements 42 of arms 34, 36 of lifting clevis 32. Each hook inner edge 48 of hook elements 42 is curved, in this preferred embodiment, so that the stem 50 of closure element 14 is collared while at the same time hook elements 42 lift against the bottom of rim 46 of closure element 14. FIG. 5 also shows how the sides (bowed portions 44) of arms 34 and 36 of lifting clevis 32 abut the inside surface of inner tube 38, here showing lifting clevis 32 raised to a position within inner tube 38.

FIG. 6 depicts more clearly the structure of lifting clevis 32 and handle 28 in the preferred embodiment. As can be seen in FIGS. 1–4, arms 34 and 36 are L-shaped, arm 34 having horizontal portion 54 and vertical portion 56; arm 36 having horizontal portion 58 and vertical portion 60. Horizontal portions 54 and 58 are both connected to the end of threaded rod 26 by bolt 62 extending through aligned apertures in both. To facilitate this, horizontal portion 58 is overlapped over horizontal portion 54. The outer ends of horizontal portions 54 and 58 extend oppositely one another and it is noted that horizontal portion 58 itself has a bent portion 64 which is slightly bent downward away from horizontal portion 54.

As can be seen in FIGS. 2–4, arm 36 has bent portion 64 in order to allow it to hinge on bolt 62 upwardly and outwardly to allow arms 34 and 36 to spread apart as shown in FIG. 4. It is to be understood that the apertures in horizontal portions 54 and 58 are large enough to allow such hinging action. It is again understood, that bolt 62 and threaded rod 26 are allowed to rotate freely within those apertures.

As can be seen in FIG. 6, and as is shown by dashed lines in FIGS. 2–4, a spring 66 is positioned within facing cavities 68 and 70 in the bottom and top surfaces of horizontal portions 54 and 58, respectively. Spring 66 constantly works to attempt to push horizontal portions 54 and 58 apart at the point where spring 66 is located and therefore constantly biases vertical portions 56 and 60 apart from one another. Therefore, bowed portions 44 of vertical portions 56 and 60 of arms 34 and 36 are constantly pushed into abutment with the inside of housing 16 or inner tube 38. This allows lifting clevis 32 to automatically be in a position such as is shown in FIG. 4 to either be inserted over the closure element 14 of a bottle 12 or to release closure element 14 once removed from bottle 12, when lifting clevis 32 is moved below inner tube 38.

It can be seen in FIG. 6 that handle 28 has a gripping portion 72 and a connection portion 74. The upper end of threaded rod 26 has a rigidly attached post 76 which is inserted through aperture 78 in connection portion 74 and into channel 80 in gripping portion 72. A set screw 82 is then inserted through aperture 84 at right angles to channel 80 and forceably contacts post 76 holding handle 26 rigidly in place on threaded rod 26.

Operation of the preferred embodiment of opening mechanism 10, as shown in the drawings, follows the simple procedure of first turning handle 28 in the appropriate direction to move threaded rod 26 downwardly to in turn move lifting clevis 32 below inner tube 38 so that spring 66 can push arms 34 and 36 of lifting clevis 32 outwardly to the inner surface of tubular housing 16, as shwon in FIG. 4. Opening mechanism 10 is then placed over the top of bottle 12 until lower end 18 of housing 12 abuts and seats against shoulder 24 of bottle 12. Handle 28 is then rotated in the appropriate direction to move threaded rod upwardly which in kind pulls lifting clevis 32 upwardly. Because the lower end 40 of inner tube 38 is aligned approximately level with rim 46 of closure element 14, once both portions 44 of arms 34 and 36 come in contact with lower end 40 of inner tube 38, hook elements 42 of arms 34 and 36 are forced inwardly to collar stem 50 of closure element 14 and continued turning of handle 28 in this direction causes closure element 14 to be removed from bottle 12 by hook elements 42 pulling on rim 46 of closure element 14, as seen in FIG. 3. Because housing 16 is seated on bottle 12, threaded rod 26 utilizes housing 16 as a brace by exerting force against housing 16. Once closure element 14 is removed, opening mechanism 10 can be lifted from bottle 12, handle 28 turned so as to move lifting clevis 32 back downwardly until it moves below inner tube 38, thereby automatically releasing closure element 14, as can be seen in FIG. 4.

The included preferred embodiment is given by way of example only, and not by way of limitation to the invention, which is solely described by the claims herein. Variations obvious to one skilled in the art will be included with the invention defined by the claims.

For example, means known in the art other than threaded rod 26 through threaded opening 30 could be used to accomplish leverage and movement of lifting clevis 32 within housing 16. It is also within the scope of the invention that threaded rod 26 be replaced by a smooth rod so that the force to remove closure element 14 will simply entail upward pulling movement of the user of opening mechanism 10. Furthermore, a ratchet or gear-type system would be obvious variations in the art.

Additionally, lifting clevis 32 could be replaced by any number of different grasping means having any number of arms but always having biasing means so that the arms are always pushed into abutment with the inner surface of housing 16 or inner tube 38. As stated before, the manner in which the arms grip the closure element 14 can be changed according to choice, depending whether the closure element has a rim or whether it is to be squeezingly grasped.

Also, housing 16 could be replaced with any different type of brace or support means, for example, three arms which would rest upon shoulder 24 of bottle 12. Along those same lines, inner tube 38, which actuates the closing of the grasping mechanism, could be replaced by vertical members having channels inside of which are raised portions corresponding to inner tube 38. It is to be understood other variations obvious in the art are also included.

It can thus be seen that the invention achieves at least all of its stated objectives.

What is claimed is:

1. An opening mechanism for sparkling wine bottles having a shoulder and a sealing stopper comprising:

a sleeve means having a top end and an open bottom, said open bottom end being position able over and around the top and neck of a bottle to be opened, said lower end being braceable against the shoulder of said bottle;

leverage means operatively associated with said sleeve means being movable with respect to said sleeve means and said bottle;

grasping means for grasping said sealing stopper of said bottle being movable between a grasping closed state and a non-grasping open state, said grasping means being operatively connected to said leverage means and being movable between a raised position and a lowered position within said sleeve means in response to movement of said leverage means;

a control means connected to said sleeve means and having an actuation portion, said control means being in the path of said grasping means between said raised and said lowered positions and between said open bottom end and said top end of said sleeve means;

said grasping means contacting said actuation portion of said control means when said grasping means is aligned with said sealing stopper of said bottle when said sleeve means is positioned upon said bottle and has engaged the shoulder of said bottle causing said grasping means to move into said closed grasping state and into grasping engagement with said sealing stopper of said bottle.

2. The mechanism of claim 1 wherein said sleeve means comprises a housing having an open end and a longitudinal cavity sufficient for insertion over the upper end and neck of said bottle to be opened including the sealing stopper of said bottle.

3. The mechanism of claim 1 wherein said leverage means comprises a rigid connecting element and means associated with said sleeve means so that any movement oppositely against said sleeve means causes said sleeve means to seat against the shoulder of said bottle and allows said leverage means to create a pulling force against said sleeve means when said opening mechanism is positioned on said bottle.

4. The mechanism of claim 1 wherein said leverage means has a threaded portion positioned within a threaded aperture of said sleeve means.

5. The mechanism of claim 1 wherein said grasping means comprises a lifting clevis having first and second clevis arms, said first and second clevis arms being movable towards and away from each other.

6. The mechanism of claim 1 wherein said grasping means comprises at least two arms having hook means at their lower ends, said arms being movable towards and away from each other.

7. The mechanism of claim 1 wherein said control means comprises at least one surface abutting said grasping means, said actuation portion of said control means comprising a raised section of said surface causing said grasping means to more to said closed grasping state.

8. The mechanism of claim 1 wherein said leverage means includes a handle member.

9. The mechanism of claim 5 wherein said arms of said lifting clevis are held apart in said non-grasping open state by a biasing means when said lifting clevis is not in said closed grasping state caused by said control means.

10. The mechanism of claim 1 wherein the lower end of said sleeve means is configured such that its position on said bottle automatically positions said actuation means of said control means in alignment with said sealing stopper of said bottle such that operation of said leverage means causes said grasping means to engage the lower rim of said sealing stopper when said sleeve means is braceably positioned on said bottle.

* * * * *